US007055991B2

(12) United States Patent
Lin

(10) Patent No.: US 7,055,991 B2
(45) Date of Patent: Jun. 6, 2006

(54) LOW-POWER HIGH-INTENSITY LIGHTING APPARATUS

(75) Inventor: Chao-Tang Lin, No. 101, Ta-Hsing St., Tung Dist., Taichung City (TW)

(73) Assignee: Chao-Tang Lin, Tauchung (TW)

( * ) Notice: Subject to any disclaimer, the term of this patent is extended or adjusted under 35 U.S.C. 154(b) by 20 days.

(21) Appl. No.: 10/923,368

(22) Filed: Aug. 20, 2004

(65) Prior Publication Data

US 2005/0157503 A1 Jul. 21, 2005

(30) Foreign Application Priority Data

Jan. 20, 2004 (TW) ..... 93101619 A

(51) Int. Cl.
*F21V 3/00* (2006.01)

(52) U.S. Cl. ..... 362/311; 362/297; 362/298; 362/302; 362/303; 362/311

(58) Field of Classification Search ..... 362/800, 362/347, 343, 342, 303, 302, 311, 296–298, 362/350

See application file for complete search history.

(56) References Cited

U.S. PATENT DOCUMENTS 3,796,886 A * 3/1974 Freeman ..... 250/493.1
4,755,916 A * 7/1988 Collins ..... 362/236
5,128,848 A * 7/1992 Enders et al. ..... 362/268
6,086,218 A * 7/2000 Robertson ..... 362/157
6,578,998 B1 * 6/2003 Zhang ..... 362/555
6,652,122 B1 * 11/2003 Lin ..... 362/250
6,758,582 B1 * 7/2004 Hsiao et al. ..... 362/302
6,851,834 B1 * 2/2005 Leysath ..... 362/303
2005/0162854 A1 * 7/2005 Finch ..... 362/304

* cited by examiner

*Primary Examiner*—Sandra O'Shea
*Assistant Examiner*—Jacob Y. Choi
(74) *Attorney, Agent, or Firm*—DLA Piper Rudnick Gray Cary US LLP

(57) ABSTRACT

A low-power high-intensity lighting apparatus includes a lamp base, a lamp housing, and a lamp unit. The lamp base includes a parabolic reflector. The lamp housing is mounted on the lamp base, and includes a surrounding wall and an optical condenser. The surrounding wall has a first open end, and a second open end opposite to the first open end. The optical condenser is mounted on the lamp housing at the second open end. The lamp unit is mounted on the lamp base, extends into the lamp housing through the first open end of the surrounding wall, and generates light that propagates toward the parabolic reflector and that is reflected by the parabolic reflector toward the optical condenser.

9 Claims, 6 Drawing Sheets

LOW-POWER HIGH-INTENSITY LIGHTING APPARATUS

CROSS-REFERENCE TO RELATED APPLICATION

This application claims priority of Taiwanese application no. 093101619, filed on Jan. 20, 2004.

BACKGROUND OF THE INVENTION

1. Field of the Invention

The invention relates to a lighting apparatus, more particularly to a low-power high-intensity lighting apparatus that includes few parts and that is easy to assemble.

2. Description of the Related Art

In U.S. Pat. No. 6,652,122, there is disclosed a conventional low-power high-intensity lighting apparatus that includes a housing, a lamp base, and a lamp unit. The housing includes a curved reflector. The lamp base includes a coupling post and a cap. The coupling post has an end that engages the reflector. The cap defines a diode-receiving cavity, and has an end that engages the coupling post. The lamp unit includes a light-emitting diode that is disposed in the diode-receiving cavity.

In use, when power is supplied to the lamp unit, the light-emitting diode generates light that propagates rearwardly toward the reflector and that is reflected forwardly by the reflector. A high luminance output is thus obtained.

Although the conventional low-power high-intensity lighting apparatus achieves its intended purpose, in order to achieve the high luminance output, numerous parts are needed. Therefore, the assembly process thereof is relatively complicated, and results in poor productivity and higher costs.

SUMMARY OF THE INVENTION

Therefore, the object of the present invention is to provide a low-power high-intensity lighting apparatus that includes few parts and that is easy to assemble.

According to one aspect of the present invention, a low-power high-intensity lighting apparatus includes a lamp base, a lamp housing, and a lamp unit. The lamp base includes a parabolic reflector. The lamp housing is mounted on the lamp base, and includes a surrounding wall and an optical condenser. The surrounding wall has a first open end, and a second open end opposite to the first open end. The optical condenser is mounted on the lamp housing at the second open end. The lamp unit is mounted on the lamp base, and extends into the lamp housing through the first open end of the surrounding wall. The lamp unit includes a light-emitting diode, and generates light that propagates toward the parabolic reflector, and that is reflected by the parabolic reflector toward the optical condenser.

According to another aspect of the present invention, a low-power high-intensity lighting apparatus includes a lamp base, a lamp housing, a reflecting unit, and a lamp unit. The lamp housing is mounted on the lamp base, and includes a surrounding wall and an optical condenser. The surrounding wall has a first open end, and a second open end opposite to the first open end of the surrounding wall. The optical condenser is mounted on the lamp housing at the second open end of the surrounding wall. The reflecting unit extends into the lamp housing through the first open end of the surrounding wall. The reflecting unit includes a light-transmissible annular wall, and first and second parabolic reflectors. The light-transmissible annular wall has a first open end, and a second open end opposite to the first open end of the annular wall. The first parabolic reflector is mounted on the second open end of the annular wall. The second parabolic reflector extends radially and outwardly from the first open end of the annular wall. The lamp unit is mounted on the lamp base, and extends into the reflecting unit through the first open end of the annular wall. The lamp unit includes a light-emitting diode, and generates light that propagates toward the first parabolic reflector, that is reflected by the first parabolic reflector toward the second parabolic reflector, and that is reflected by the second parabolic reflector toward the optical condenser.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
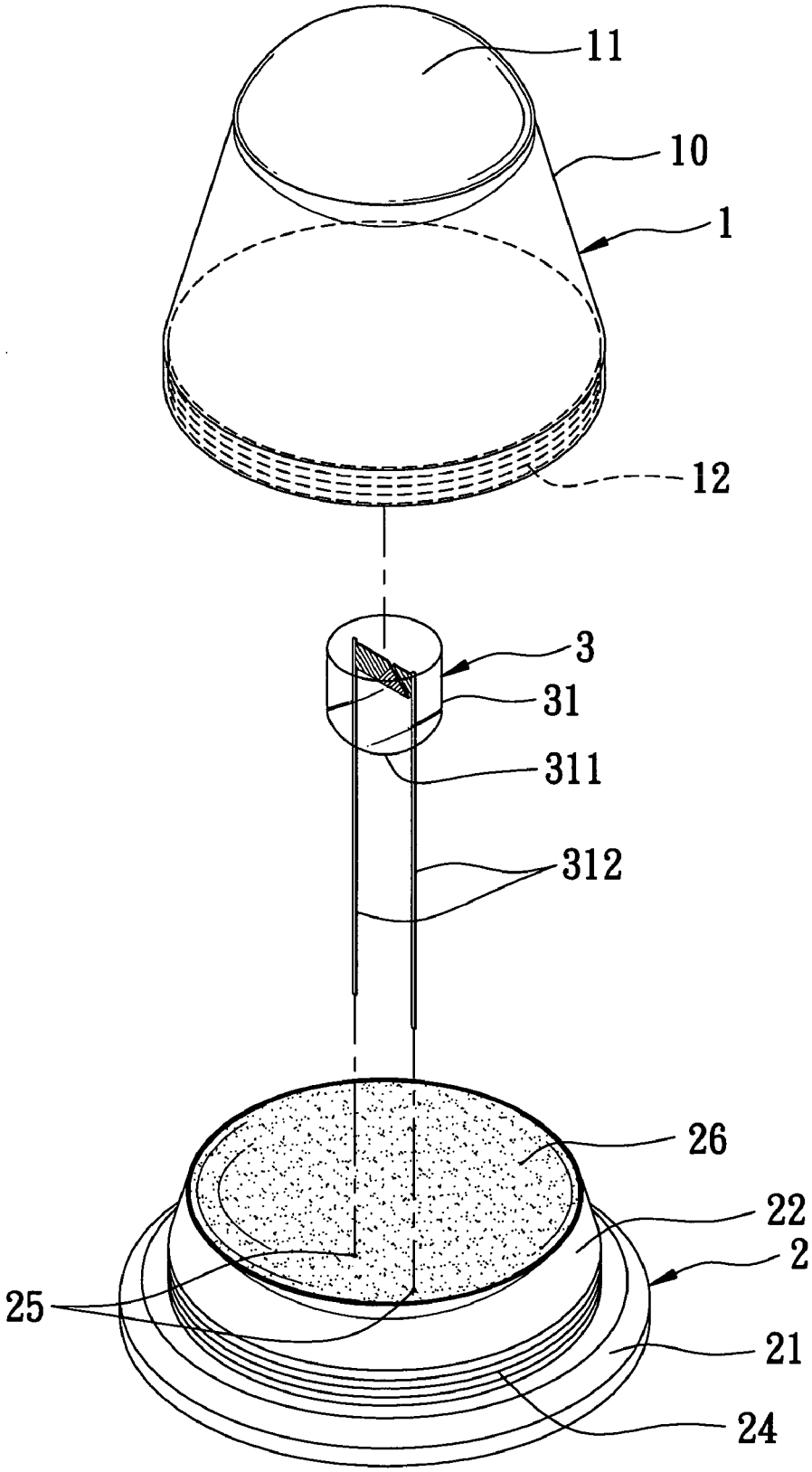
FIG. 1 is an exploded perspective view of the first preferred embodiment of a low-power high-intensity lighting apparatus according to the present invention.

Before the present invention is described in greater detail, it should be noted that like elements are denoted by the same reference numerals throughout the disclosure.

Figure 2:
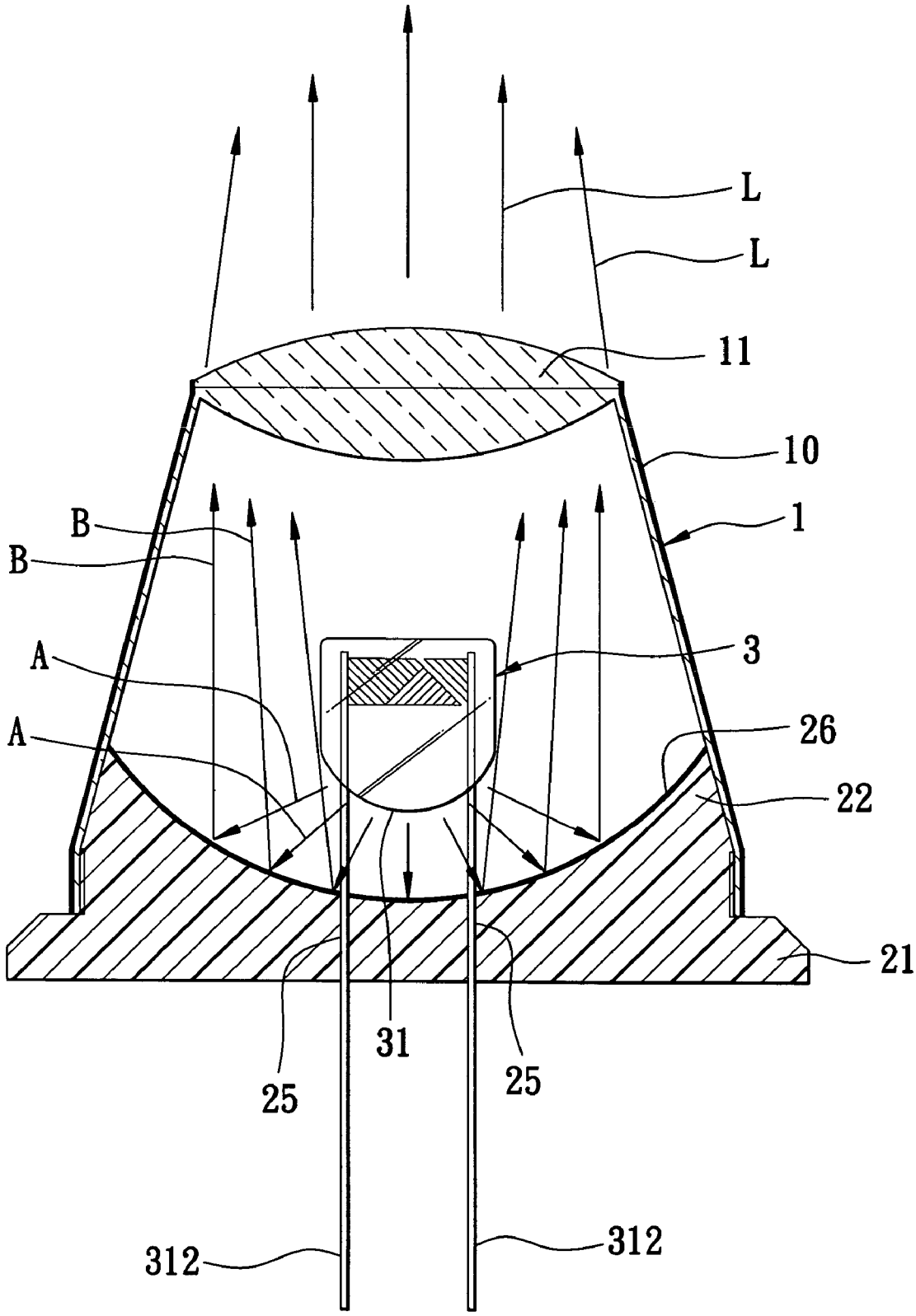
FIG. 2 is a sectional view of the first preferred embodiment in an assembled state.

Referring to FIGS. 1 and 2, the first preferred embodiment of a low-power high-intensity lighting apparatus according to this invention is shown to include a lamp base 2, a lamp housing 1, and a lamp unit 3.

The lamp base 2 has a base part 21, a mounting part 22 opposite to the base part 21, and a peripheral part 24 that interconnects the base and mounting parts 21, 22. In this embodiment, the lamp base 2 includes a parabolic reflector 26 that is formed at the mounting part 22. The peripheral part 24 of the lamp base 2 is formed with an outer thread. The lamp base 2 is further formed with a pair of terminal holes 25 that extend through the parabolic reflector 26.

The lamp housing 1 is mounted on the lamp base 2. In this embodiment, the lamp housing 1 includes a surrounding wall 10 and an optical condenser 11. The surrounding wall 10 has a first open end, and a second open end that is opposite to and that has a smaller diameter than that of the first open end. The first open end of the surrounding wall 10 is defined by a periphery 12 formed with an inner thread. The outer thread of the peripheral part 24 engages the inner thread of the surrounding wall 10 when the lamp housing 1 is mounted on the lamp base 2. The optical condenser 11 is mounted on the second open end of the surrounding wall 10 of the lamp housing 1. Preferably, the optical condenser 11 is a biconvex lens.

The lamp unit 3 is mounted on the lamp base 2, and extends into the lamp housing 1 through the first open end of the surrounding wall 10. In this embodiment, the lamp unit 3 includes a light-emitting diode 31 that has a light-transmissible shell 311 and a pair of diode terminals 312 extending from the light-transmissible shell 311. Preferably, the light-emitting diode 31 is a high-brightness light-emitting diode. The light-transmissible shell 311 has a convex light-radiating end through which the diode terminals 312 extend.

It is noted that the diode terminals 312 pass through the terminal holes 25 in the lamp base 2 for securing the lamp unit 3 on the lamp base 2. The construction as such permits the low-power high intensity lighting apparatus of this invention to be conveniently mounted to couple the diode terminals 312 to a power source (not shown).

It is also noted that the surrounding wall 10 of the lamp housing 1 does not permit light transmission therethrough. Therefore, the light reflected by the parabolic reflector 26 is concentrated on the optical condenser 11. As such, the light generated by the light-emitting diode 31 of the lamp unit 3 can be visible from a relatively farther range.

In use, when power is supplied to the lamp unit 3, the light-emitting diode 31 generates light that propagates toward the parabolic reflector 26, as indicated by the arrows (A), and that is reflected by the parabolic reflector 26 toward the optical condenser 11, as indicated by the arrows (B). A high luminance output (L) is thus obtained.

Figure 3:
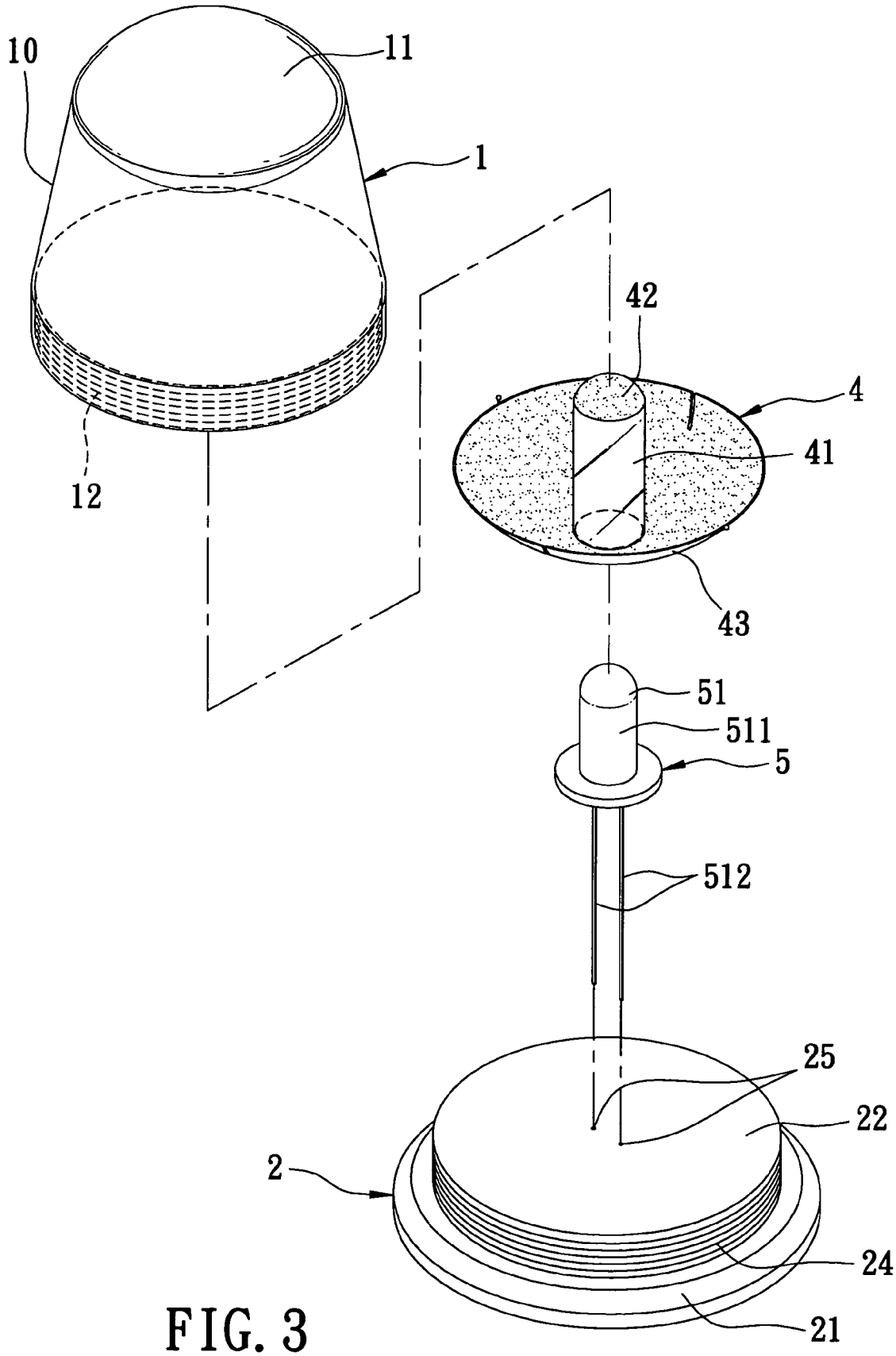
FIG. 3 is an exploded perspective view of the second preferred embodiment of a low-power high-intensity lighting apparatus according to the present invention.
Figure 4:
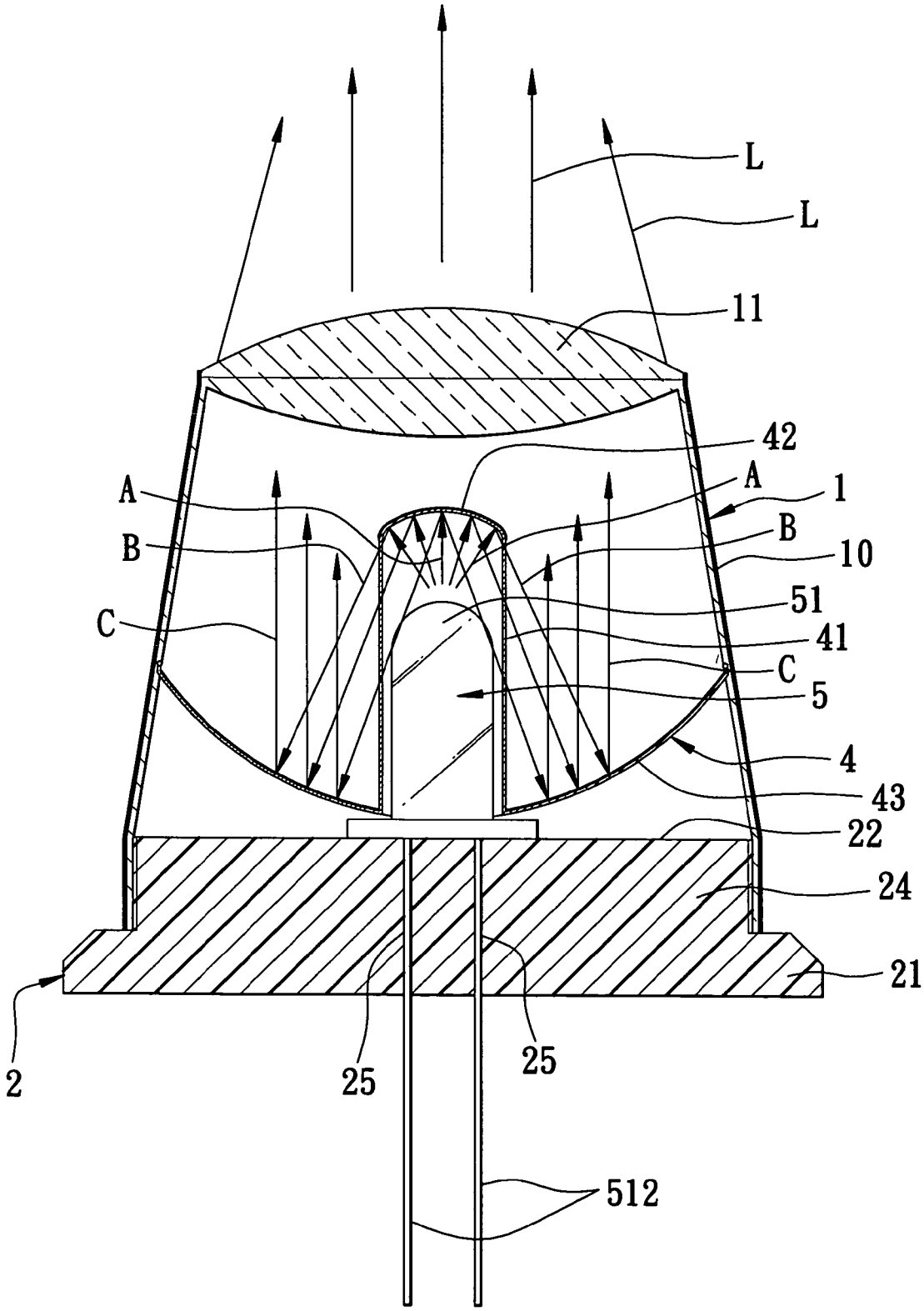
FIG. 4 is a sectional view of the second preferred embodiment in an assembled state.

FIGS. 3 and 4 illustrate the second preferred embodiment of a low-power high-intensity lighting apparatus according to this invention. When compared with the previous embodiment, the lamp base 2 is dispensed with the parabolic reflector 26. The low-power high-intensity lighting apparatus further includes a reflecting unit 4 that extends into the lamp housing 1 through the first open end of the surrounding wall 10. In this embodiment, the reflecting unit 4 includes a light-transmissible annular wall 41 that has opposite first and second open ends, a first parabolic reflector 42 that is mounted on the second open end of the annular wall 41, and a second parabolic reflector 43 that extends radially and outwardly from a periphery of the first open end of the annular wall 41. The lamp unit 5 is mounted on the lamp base 2, and extends into the reflecting unit 4 through the first open end of the annular wall 41. In this embodiment, the lamp unit 5 includes a light-emitting diode 51 that has a light-transmissible shell 511 and a pair of diode terminals 512 extending from the light-transmissible shell 511. The light-transmissible shell 511 has a convex light-radiating end that is directed away from the diode terminals 512.

It is noted that the diode terminals 512 pass through the terminal holes 25 in the lamp base 2 for securing the lamp unit 5 on the lamp base 2. The construction as such permits the low-power high intensity lighting apparatus of this invention to be conveniently mounted to couple the diode terminals 512 to a power source (not shown).

In use, when power is supplied to the lamp unit 5, the light-emitting diode 51 generates light that propagates toward the first parabolic reflector 42, as indicated by the arrows (A), that is reflected by the first parabolic reflector 42 toward the second parabolic reflector 43, as indicated by the arrows (B), and is reflected by the second parabolic reflector 43 toward the optical condenser 11, as indicated by the arrows (C). A high luminance output (L) is thus obtained.

Figure 5:
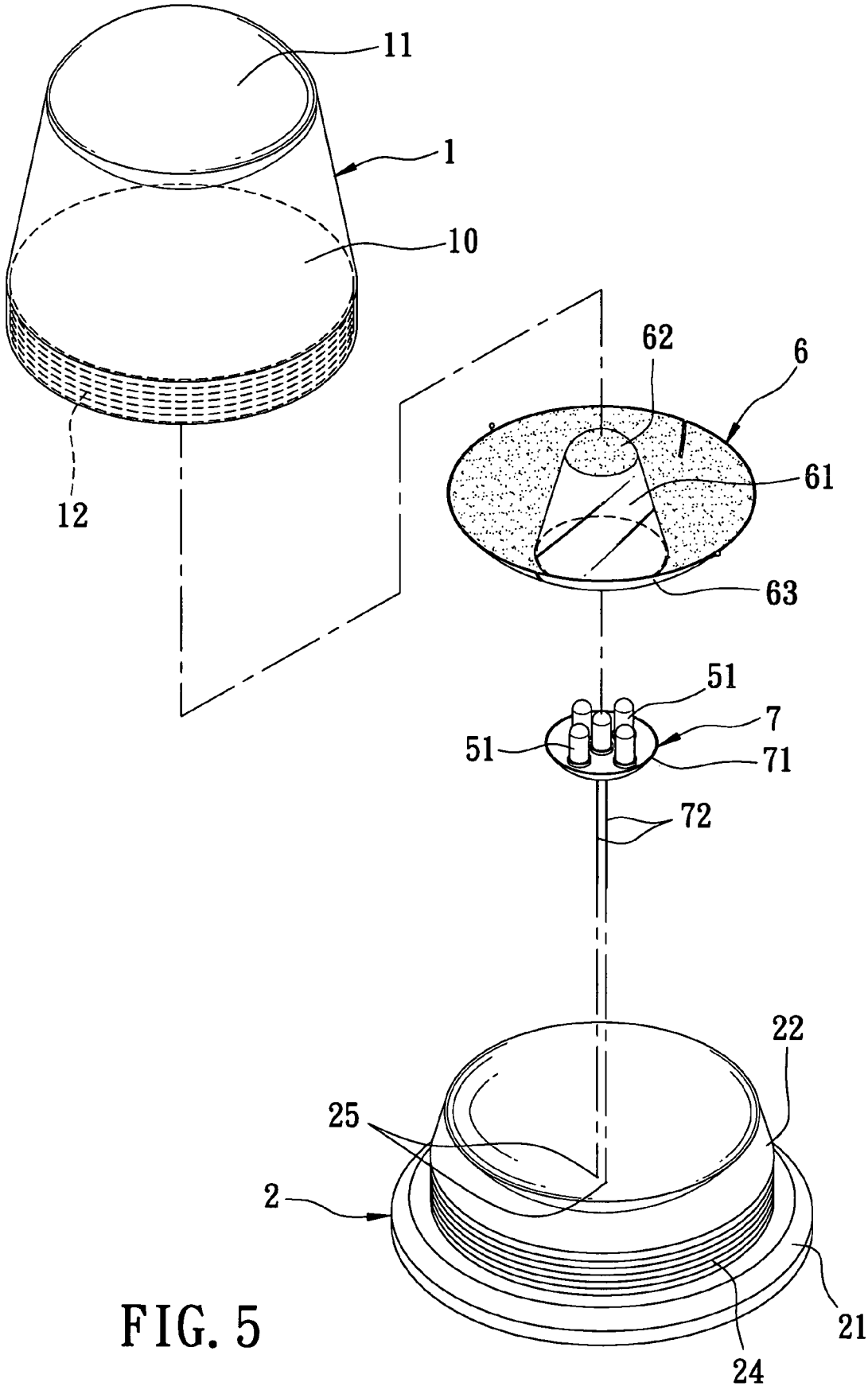
FIG. 5 is an exploded perspective view of the third preferred embodiment of a low-power high-intensity lighting apparatus according to the present invention.
Figure 6:
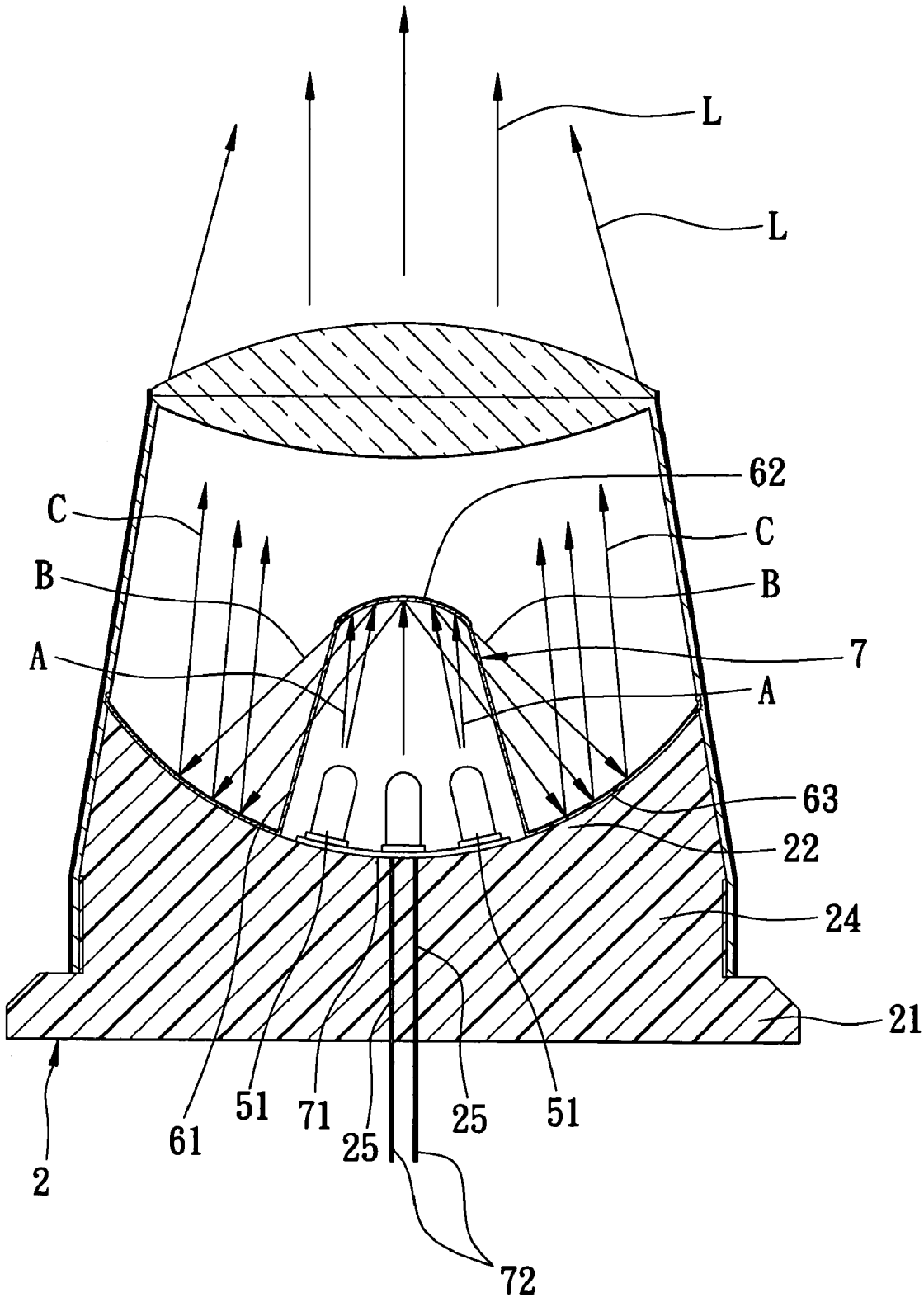
FIG. 6 is a sectional view of the third preferred embodiment in an assembled state.

FIGS. 5 and 6 illustrate the third preferred embodiment of a low-power high-intensity lighting apparatus according to this invention. When compared with the first preferred embodiment, the low-power high-intensity lighting apparatus further includes a reflecting unit 6 that is mounted on the lamp base 2 and that extends into the lamp housing 1 through the first open end of the surrounding wall 10. In this embodiment, the reflecting unit 6 includes a light-transmissible annular wall 61 that has opposite first and second open ends, a first parabolic reflector 62 that is mounted on the second open end of the annular wall 61, and a second parabolic reflector 63 that extends radially and outwardly from a periphery of the first open end of the annular wall 61. The lamp unit 7 is mounted on the lamp base 2, and extends into the reflecting unit 6 through the first open end of the annular wall 61. In this embodiment, the lamp unit 7 includes a plurality of the light-emitting diodes 51 (see FIG. 3) of the second preferred embodiment. The lamp unit 7 further includes a circuit board 71, and a pair of lamp terminals 72 coupled to the circuit board 71. Each of the light-emitting diodes 51 is mounted on the circuit board 71 and is coupled to the lamp terminals 72.

It is noted that the first open end of the annular wall 61 has a diameter larger than that of the second open end of the annular wall 61.

It is also noted that the mounting part 22 of the lamp base 2 has a curved surface that corresponds to that of the circuit board 71 such that the circuit board 71 rests on the mounting part 22 when the lamp unit 7 is mounted on the lamp base 2.

It is further noted that the lamp terminals 72 pass through the terminal holes 25 in the lamp base 2 for securing the lamp unit 7 on the lamp base 2. The construction as such permits the low-power high intensity lighting apparatus of this invention to be conveniently mounted to couple the lamp terminals 72 to a power source (not shown).

In use, when power is supplied to the lamp unit 7, each of the light-emitting diodes 51 generates light that propagates toward the first parabolic reflector 62, as indicated by the arrows (A), that is reflected by the first parabolic reflector 62 toward the second parabolic reflector 63, as indicated by the arrows (B), and that is reflected by the second parabolic reflector 63 toward the optical condenser 11, as indicated by the arrows (C). A high luminance output (L) is thus obtained.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A low-power high-intensity lighting apparatus comprising:

a lamp base;

a lamp housing mounted on said lamp base, said lamp housing including a surrounding wall that has a first open end, and a second open end apposite to said first open end of said surrounding wall, and an optical condenser mounted on said lamp housing at said second open end of said surrounding wall;

a reflecting unit extending into said lamp housing through said first open end of said surrounding wall, said reflecting unit including a light-transmissible annular wall that has a first open end, and a second open end opposite to said first open end of said annular wall, a first parabolic reflector mounted on said second open end of said annular wall, and a second parabolic reflector that extends radially and outwardly from said first open end of said annular wall;

and a lamp unit mounted on said lamp base and extending into said reflecting unit through said first open end of said annular wall, said lamp unit including a light-emitting diode, and generating light that propagates toward said first parabolic reflector, that is reflected by said first parabolic reflector toward said second parabolic reflector, and that is reflected by said second parabolic reflector toward said optical condenser.

2. The low-power high-intensity lighting apparatus as claimed in claim 1, wherein said first open end of said surrounding wall is defined by a periphery formed with an inner thread, said lamp base having a peripheral part formed with an outer thread to engage said inner thread of said surrounding wall when said lamp housing is mounted on said lamp base.

3. The low-power high-intensity lighting apparatus as claimed in claim 1, wherein said optical condenser is a biconvex lens.

4. The low-power high-intensity lighting apparatus as claimed in claim 1, wherein said light emitting diode of said lamp unit has a light-transmissible shell and a pair of diode terminals that extend from said light-transmissible shell.

5. The low-power high-intensity lighting apparatus as claimed in claim 4, wherein said light-transmissible shell has a convex light-radiating end that is directed away from said diode terminals.

6. The low-power high-intensity lighting apparatus as claimed in claim 4, wherein said diode terminals of said light-emitting diode pass through said lamp base.

7. The low-power high-intensity lighting apparatus as claimed in claim 1, wherein said light-emitting diode is a high-brightness light-emitting diode.

8. The low-power high-intensity lighting apparatus as claimed in claim 1, wherein said lamp unit further includes a circuit board, and a pair of lamp terminals coupled to said circuit board, said light-emitting diode being mounted on said circuit board and being coupled to said lamp terminals.

9. The low-power high-intensity lighting apparatus as claimed in claim 8, wherein said first open end of said annular wall has a diameter larger than that of said second open end of said annular wall.

* * * * *